US010624399B2

(12) United States Patent
Stratton

(10) Patent No.: US 10,624,399 B2
(45) Date of Patent: Apr. 21, 2020

(54) GARMENT FOR HOLDING LVAD PERIPHERALS

(71) Applicant: John Stratton, Norfolk, VA (US)

(72) Inventor: John Stratton, Norfolk, VA (US)

( * ) Notice: Subject to any disclaimer, the term of this patent is extended or adjusted under 35 U.S.C. 154(b) by 111 days.

(21) Appl. No.: 15/939,546

(22) Filed: Mar. 29, 2018

(65) Prior Publication Data

US 2018/0279703 A1 Oct. 4, 2018

Related U.S. Application Data

(60) Provisional application No. 62/479,702, filed on Mar. 31, 2017.

(51) Int. Cl.
*A41D 13/12* (2006.01)
*A41D 27/20* (2006.01)
*A41D 1/04* (2006.01)

(52) U.S. Cl.
CPC ..... *A41D 27/205* (2013.01); *A41D 1/04* (2013.01); *A41D 13/1281* (2013.01); *A41D 13/1245* (2013.01)

(58) Field of Classification Search
CPC ..... A41D 13/1245; A41D 13/1281; A61M 2025/0206
See application file for complete search history.

(56) References Cited

U.S. PATENT DOCUMENTS 4,578,062 A * 3/1986 Schneider ..... A41D 13/1245 128/DIG. 26
4,666,432 A * 5/1987 McNeish ..... A61M 25/02 128/DIG. 26
5,142,702 A * 9/1992 Piloian ..... A41D 13/1245 2/102
5,755,698 A * 5/1998 Kagan ..... A61M 25/02 128/DIG. 26
6,477,710 B1 * 11/2002 Ojoyeyi ..... A41D 13/1236 2/114
6,681,404 B1 * 1/2004 Adlard ..... A41D 13/1245 2/94
7,823,221 B2 * 11/2010 Green ..... A61F 5/4408 2/114
2010/0042051 A1 * 2/2010 Walker ..... A41D 13/1245 604/174
2016/0213886 A1 * 7/2016 DiGiorgi ..... A61M 25/02

* cited by examiner

*Primary Examiner* — Tajash D Patel
(74) *Attorney, Agent, or Firm* — William G. Sykes

(57) ABSTRACT

A garment having accommodation for the driveline and support peripherals of a LVAD is shown and described. The garment is preferably formed in two sections including an upper body sheath and a lower body tube. These sections may overlap. The garment includes a slot for passing a driveline of the LVAD, and pockets for containing each of the support peripherals such as controller and batteries. The pockets hold the support peripherals close to the body with even distribution of weight of the support peripherals with respect to right and left sides of the body, compared with prior art practice of containing the peripherals in a bag slung over the shoulder.

12 Claims, 2 Drawing Sheets

GARMENT FOR HOLDING LVAD PERIPHERALS

RELATED APPLICATIONS

This application claims priority in accordance with 37 CF.R. ¶ 1.19(e) to U.S. Provisional Patent Application Ser. No. 62/479,702 filed for TWO PIECE MEDICAL EQUIPMENT GARMENT (Note: Inventor changed the name to GARMENT FOR HOLDING LVAD PERIPHERALS to be more descriptive) filed Mar. 31, 2017 which is included herein in its entirety by reference.

FIELD OF THE INVENTION

The present invention relates to apparel, and more particularly, to a garment adapted to hold devices for supporting a surgically implanted left ventricular assist device (LVAD) on a patient's body.

BACKGROUND OF THE INVENTION

LVADs, also known as VADs, must be served by battery power, must communicate data to the external world, and must be monitored. The LVAD itself is surgically implanted within the body, with support peripherals such as batteries, controller, and monitor kept externally to the body. The drive line exits the body and is connected to the support peripherals including batteries and a controller or monitor. These support peripherals must be kept near the body.

This situation presents problems to patients, in that a patient having a LVAD is able to perform most ordinary functions. Support peripherals and the exposed portion of the driveline, the latter being a flexible cable communicating between the LVAD and its support peripherals, are subject to hazards such as impacts with environmental objects, being caught on clothing or even environmental objects, and the like. Currently, the support peripherals may be contained in a bag typically slung over one shoulder. The bag is susceptible to swinging about, and potentially causing the support peripherals to strike an environmental object.

There exists a need for apparel which will accommodate and protect the driveline and support peripherals while enabling ordinary activities.

SUMMARY OF THE INVENTION

The present invention addresses the above concerns by providing a garment having accommodation for the driveline and support peripherals of a LVAD. The garment includes pockets for containing each of the support peripherals and holding these close to the body with even distribution of weight of the support peripherals with respect to right and left sides of the body.

The present invention provides improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
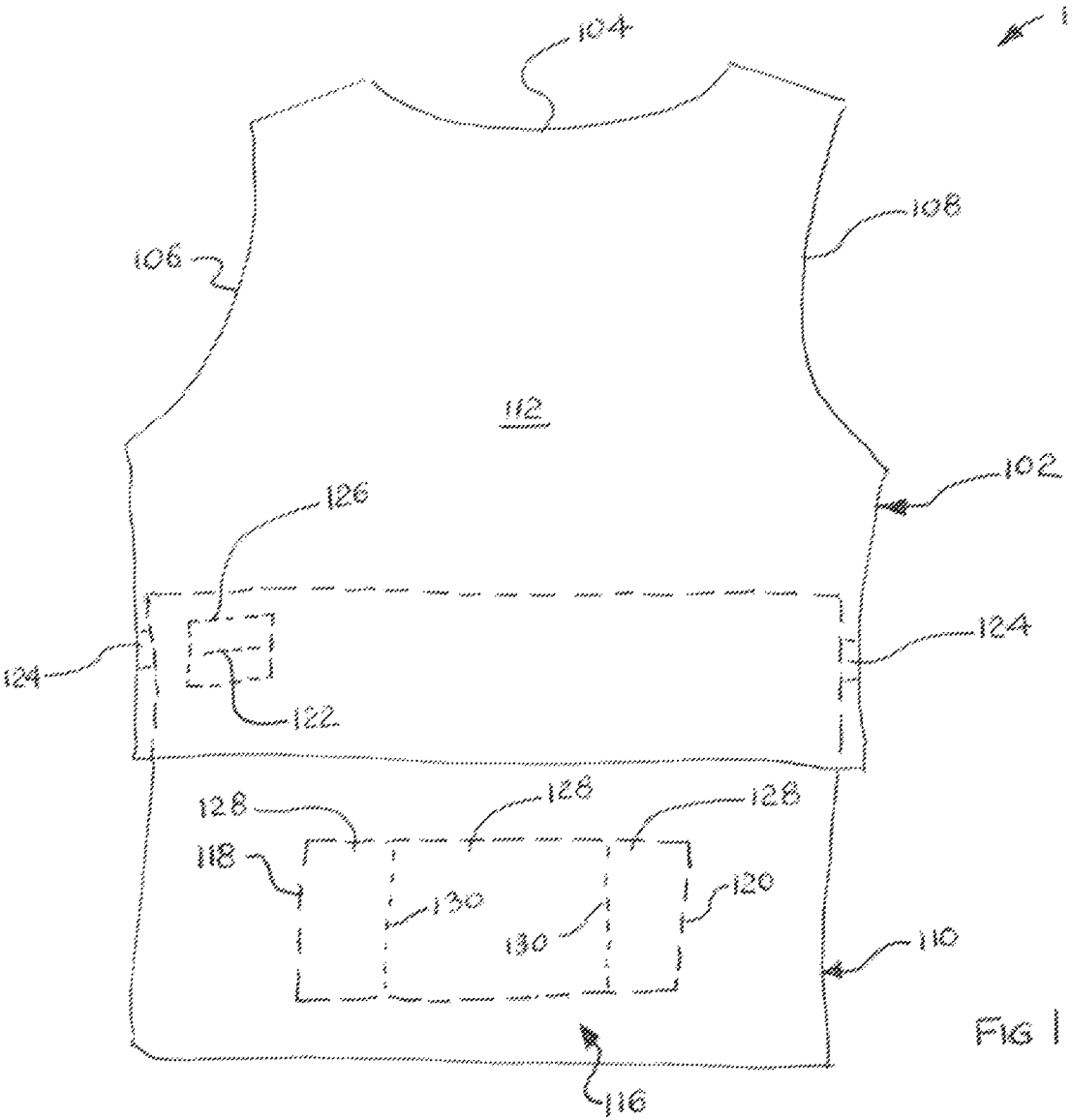
FIG. 1 is a front plan view of a garment adapted to hold peripheral support devices for supporting a left ventricular assist device on a patient's body, according to at least one aspect of the invention.

Referring first to FIG. 1, according to at least one aspect of the invention, there is shown a garment 100 adapted to hold peripheral support devices (not shown) for supporting a surgically implanted left ventricular assist device (LVAD) (not shown) on a patient's body (not shown). Garment 100 may comprise an upper body sheath 102 including a neck opening 104, a right arm opening 106, and a left arm opening 108, and a lower body tube 110 for encircling a torso of the patient's body. Lower body tube 110 may include a front panel 112 and a rear panel 114 joined to the front panel, at least a first pocket 116 on front panel 112 on an interior surface of front panel 112. First pocket 116 opens towards neck opening 104 so that devices placed therein are held by gravity when the body is upright. First pocket 116 is closed at a bottom thereof and has a right-side wall 118 and a left side wall 120 so that the devices are prevented from loss at the right and left sides of the body.

Garment 100 includes a slot 122 in one of upper body sheath 102 and lower body tube 110 at a right side of garment 100, for passing an exposed portion of a driveline (not shown) of an LVAD from the patient's body to first pocket 116.

It should be noted at this point that orientational terms such as upper, lower, right, left, and vertical refer to the subject drawing as viewed by an observer. The drawing figures depict their subject matter in orientations of normal use, which could obviously change with changes in posture and position of the body of the user. Therefore, orientational terms must be understood to provide semantic basis for purposes of description, and do not limit the invention or its component parts in any particular way.

Unless otherwise indicated, the terms "first", "second", etc., are used herein merely as labels, and are not intended to impose ordinal, positional, or hierarchical requirements on the items to which these terms refer. Moreover, reference to, e.g., a "second" item does not either require or preclude the existence of, e.g., a "first" or lower-numbered item, and/or, e.g., a "third" or higher-numbered item.

Slot 122 may be formed in a reinforcement patch 126 on garment 100. Reinforcement patch 126 may comprise neoprene material.

Description of upper body sheath 102 as comprising front and rear panels 112, 114 does not imply that these are separate. Rather, upper body sheath 102 may be continuous. Designation of front and rear panels 112, 114 is a semantic convenience for describing location of first pocket 116 as being on an inside surface of a front portion of upper body sheath 102.

Figure 2:
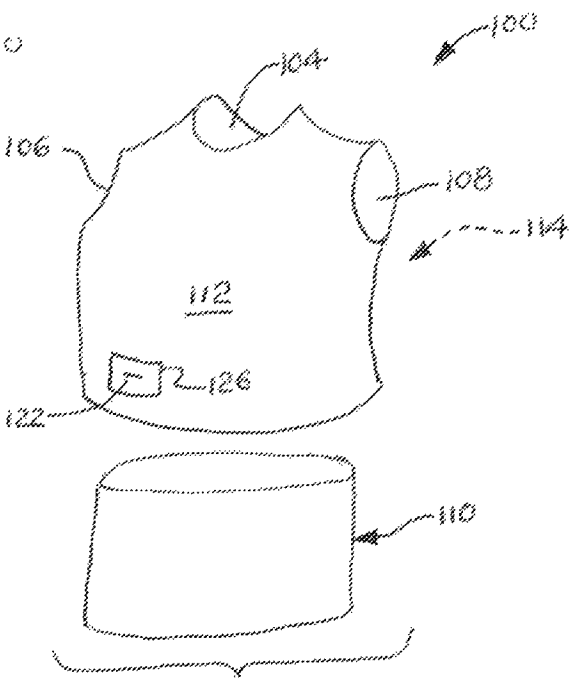
FIG. 2 is an exploded perspective view of the garment of FIG. 1.

Upper body sheath 102 and lower body tube 110 may be two separate components of garment 100 (as seen especially in FIG. 2) Garment 100 may further comprise at least one connector 124 detachably coupling upper body sheath 102 to the lower body tube 110, whereby upper body sheath 102 and lower body tube 110 may be worn as a single garment. Connector 124 may comprise complementary patches of hook and loop fastener, buttons, snaps, or hook and eye, for example.

First pocket 116 may comprise a plurality of abutting second pockets 128, whereby each individual peripheral support device is provided with one associated one of second pockets 128 but is separated from each other individual peripheral support device. For example, second pockets 128 may be formed by stitching seams compartmentalizing first pocket 116.

Figure 4:
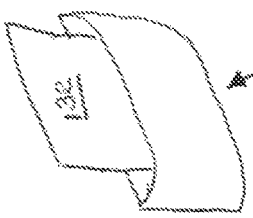
FIG. 4 is a perspective detail view, slightly exploded, of a component seen towards the bottom of FIG. 3.
Figure 3:
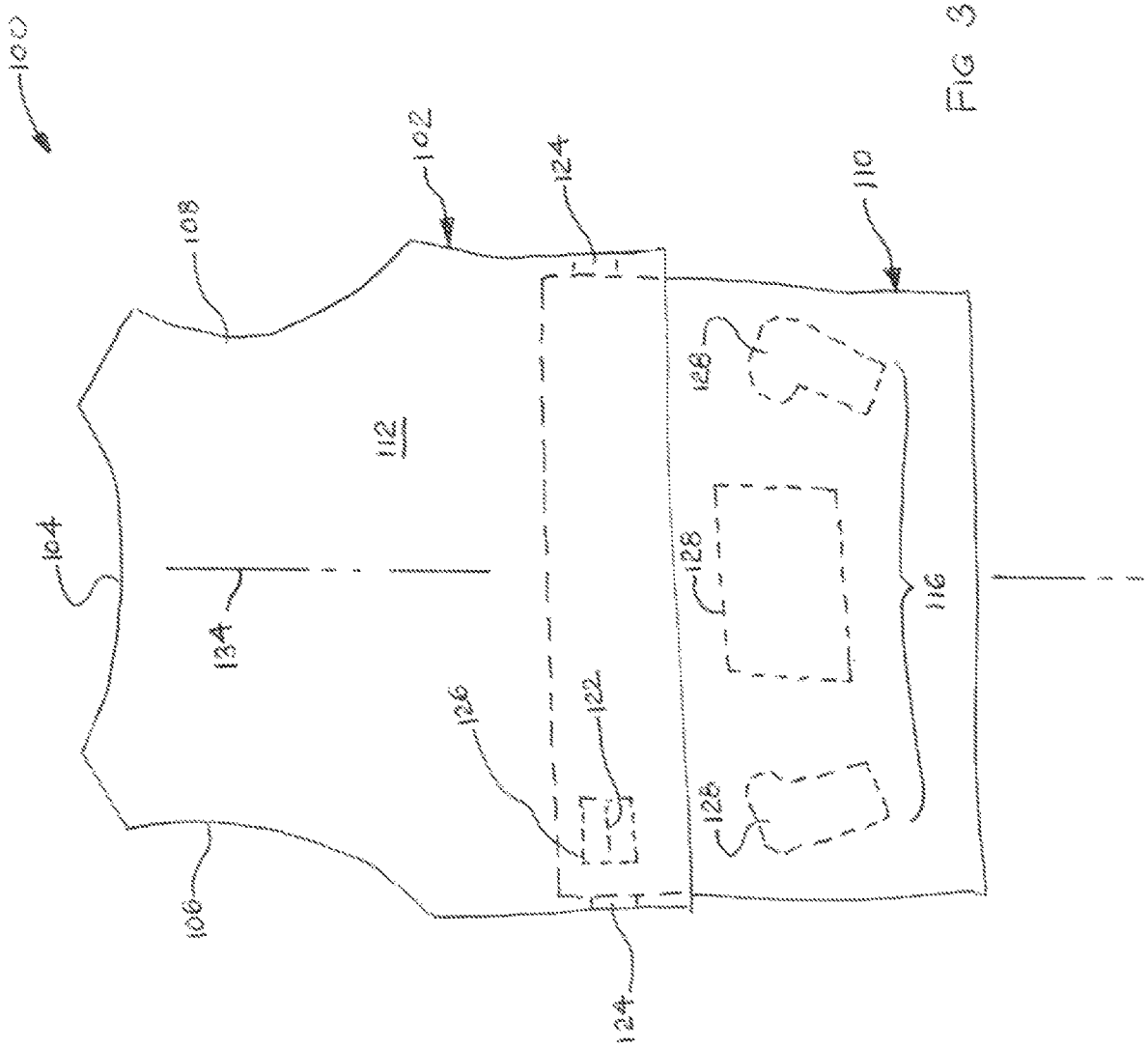
FIG. 3 is a front plan view of a garment adapted to hold peripheral support devices for supporting a left ventricular assist device on a patient's body, according to at least one further aspect of the invention.

Turning now to FIGS. 3 and 4, a second embodiment of garment 100 is described. In the second embodiment, first pocket 116 comprises a plurality of spaced apart second pockets 128, whereby each individual peripheral support device is provided with one associated one of second pockets 128 and is spaced apart from each other individual peripheral support device.

In the second embodiment of garment 100, first pocket 116 comprises a plurality of second pockets 128, wherein one of second pockets 128 comprises a thermal barrier 132 to isolate the patient's body from heat generated by the controller. Thermal barrier 132 may comprise a flexible material having a heat transmission characteristic less than constituent materials forming upper body sheath 102 and lower body tube 110. Examples include expanded fibrous or cellular polymeric materials (not shown).

Upper body sheath 102 and lower body tube 110 may comprise a breathable fabric. The breathable fabric may comprise a blend of polyester and an elastic polyurethane, for example.

As seen in FIGS. 1 and 3, upper body sheath 102 and lower body tube 110 overlap one another for at least four inches along a vertical distance when the user is standing upright. The overlap is where lower body tube 110 is rendered in broken lines.

In the embodiments of FIGS. 1 and 3, at least one pocket 116 or 128 is located on lower body tube 110. Alternatively, it would be possible to locate at least one pocket 116 or 128 on upper body sheath 102 if desired (this embodiment is not illustrated). In such a case, it would be desirable to provide an access opening in upper body sheath 102 for installation of a support peripheral in the pocket and for removal thereof.

In any embodiment of the invention, the at least one pocket 116 or 128 may be located symmetrically about a vertical axis 134 of garment 100. Vertical axis 134 is shown in FIG. 3, but obviously applies to any embodiment of the invention. This distribution of pockets 116 or 128 leads to comfortable distribution of weight of the support peripherals when the latter are contained in pockets 116 or 128.

The present invention is susceptible to modifications and variations which may be introduced thereto without departing from the inventive concepts. For example, although upper body sheath 102 and lower body tube 110 have been described as separate components, garment 100 may be formed with these two components integrated with one another. In this embodiment (not shown), it would be advantageous to provide an opening for access to first pocket 116. Donning this embodiment of the invention would be easy as it is donned and may be worn in the manner of a pullover vest (not shown).

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A garment adapted to hold peripheral support devices for supporting a surgically implanted left ventricular assist device (LVAD) on a patient's body, the garment comprising:

an upper body sheath including a neck opening, a right arm opening, and a left arm opening;

a lower body tube for encircling a torso of the patient's body, the lower body tube including a front panel and a rear panel joined to the front panel, at least a first pocket on the front panel on an interior surface of the front panel, the first pocket opening towards the neck opening so that devices placed therein are held by gravity when the body is upright, the first pocket closed at a bottom thereof and having a right side wall and a left side wall so that the devices are prevented from loss at the right and left sides of the body; and a slot in one of the upper body sheath and the lower body tube at a right side of the garment, for passing an exposed portion of a driveline of an LVAD from the body to the first pocket.

2. The garment of claim 1, wherein the upper body sheath and the lower body tube are two separate components of the garment, the garment further comprising at least one connector detachably coupling the upper body sheath to the lower body tube.

3. The garment of claim 1, wherein the slot is formed in a reinforcement patch on the garment.

4. The garment of claim 3, wherein the reinforcement patch comprises neoprene material.

5. The garment of claim 1, wherein the first pocket comprises a plurality of abutting second pockets, whereby each individual peripheral support device is provided with one associated one of the second pockets but is separated from each other individual peripheral support device.

6. The garment of claim 1, wherein the first pocket comprises a plurality of spaced apart second pockets, whereby each individual peripheral support device is provided with one associated one of the second pockets and is spaced apart from each other individual peripheral support device.

7. The garment of claim 1, wherein the first pocket comprises a plurality of second pockets, wherein one of the second pockets comprises a thermal barrier to isolate the patient's body from heat generated by the controller.

8. The garment of claim 1, wherein the upper body sheath and the lower body tube comprise a breathable fabric.

9. The garment of claim 8, wherein the breathable fabric comprises a blend of polyester and an elastic polyurethane.

10. The garment of claim 1, wherein the upper body sheath and the lower body tube overlap one another for at least four inches along a vertical distance when the user is standing upright.

11. The garment of claim 1, wherein at least one pocket is located on the lower body tube.

12. The garment of claim 1, wherein the at least one pocket is located symmetrically about a vertical axis of the garment.

* * * * *